United States Patent [19]

Simard

[11] Patent Number: 4,746,012

[45] Date of Patent: May 24, 1988

[54] SMOKER'S PACKAGE INCLUDING A CIGARETTE OR CIGAR PULLING STRING

[76] Inventor: Laval Simard, 893, des Rochers, St-Félicien, Quebec, Canada, G0W 2N0

[21] Appl. No.: 7,659

[22] Filed: Jan. 28, 1987

[51] Int. Cl.[4] ..... B65D 85/10; B65D 85/12

[52] U.S. Cl. ..... 206/254

[58] Field of Search ..... 206/254, 249, 253, 247, 206/261, 264, 619, 256

[56] References Cited

U.S. PATENT DOCUMENTS

| | | | |
|---|---|---|---|
| 906,444 | 12/1908 | Michel | 206/264 |
| 1,586,248 | 5/1926 | Komura | 206/254 X |
| 1,809,218 | 6/1931 | Riddell | 206/254 X |
| 1,819,427 | 8/1931 | Maisto | 206/254 X |
| 1,902,963 | 3/1933 | Lepage et al. | 206/254 X |
| 2,129,887 | 9/1938 | Tamarin | 206/254 X |
| 2,258,170 | 10/1941 | Austin et al. | 206/254 X |
| 2,347,381 | 4/1944 | West | 206/264 X |
| 2,415,117 | 2/1947 | Tamarin | 206/247 |
| 2,812,057 | 11/1957 | Brownfield | 206/254 X |
| 2,849,154 | 8/1958 | Gartrell et al. | 206/254 X |
| 2,868,363 | 1/1959 | Legnaioli | 206/264 |
| 3,039,671 | 6/1962 | Chiamardas | 206/264 X |

FOREIGN PATENT DOCUMENTS

| | | | |
|---|---|---|---|
| 796592 | 10/1968 | Canada | 206/254 |
| 1030996 | 3/1953 | France | 206/254 |
| 1112651 | 11/1955 | France | 206/254 |
| 524580 | 4/1955 | Italy | 206/254 |
| 11681 | 2/1924 | Netherlands | 206/254 |
| 81881 | 10/1934 | Sweden | 206/254 |
| 532784 | 1/1941 | United Kingdom | 206/254 |

*Primary Examiner*—William Price

*Attorney, Agent, or Firm*—Larson and Taylor

[57] ABSTRACT

A smoker's package contains a plurality of tightly packed smoking tobacco rolls, such as cigarettes or cigars, contained in a wrapper. One of the rolls is provided with a pull string wound freely around it and having one free end projecting from the top end of the roll so that it may be seized by the fingers when it is desired to remove the roll from the wrapper. The pull string has a winding length selected so that, when pulled, it creates a bracing force on the one roll of such a magnitude as to overcome the packing pressure acting on the said one roll, thereby allowing withdrawal of the roll from the other rolls.

5 Claims, 1 Drawing Sheet

SMOKER'S PACKAGE INCLUDING A CIGARETTE OR CIGAR PULLING STRING

BACKGROUND OF THE INVENTION

1. Field of the invention

The present invention relates to a smoker's package containing cigarettes or cigars.

2. Description of the prior art

It is well known that cigarettes or cigars are tightly packed in smoker's packages and it is thus always with difficulties that a user may withdraw the first cigarette or cigar. This is particularly the case with packed cigarettes. Once the first cigarette is removed, the remaining ones come out easily but it is always the first one that presents difficulties.

A search of the prior art has revealed the following several U.S. patents where solutions to the above problem have been proposed:

1,586,248: Komura, 1926
1,809,218: Riddell, 1931
1,819,427: Maisto, 1931
1,902,963: Lepage et al, 1933
2,129,887: Tamarin, 1938
2,258,170: Austin et al, 1941
2,347,381: West, 1944
2,849,154: Gartrell et al, 1958

The most relevant of these documents with respect to the present invention would appear to be U.S. Pat. No. 2,347,381 to West which discloses the use of a string disposed downwardly in the package along opposite sides thereof and across its bottom beneath three cigarettes to be removed. Because of its particular disposition and the fact that the first three cigarettes are attempted to be removed together, the stress that pulling on the string develops at the bottom of these three cigarettes would appear to result in a possible crushing of the lower ends of the cigarettes.

The arrangement is also complex from a manufacturing point of view.

U.S. Pat. No. 1,809,218 to Riddell is also pertinent inasmuch as it proposes a flexible tab at the top of the cigarette paper envelope. The weakness here would appear to be in that a tear line must be provided between the tab and the wrapper which could bring untimely removal of the tab if the tear line is too weak, before the first cigarette is removed. If the tear line is too strong, on the other hand, removal of the tab after the cigarette is pulled out may require crushing of the cigarette by the holding fingers as well as possible tearing of the paper envelope. From a manufacturer's stand point, this proposal complicates manufacture by having to add tabs to all envelopes where only one cigarette need actually be provided with it.

The other patents only have a remote interest in respect to the present invention.

SUMMARY OF THE INVENTION

The present invention comprises, in combination, a smoker's package of the type comprising a container enclosing a plurality of tobacco rolls, each tobacco roll being removed from the container by exerting a pulling force on the tobacco roll along the longitudinal axis thereof, a tobacco roll ejector device comprising an elongated flexible element spirally wound on a tobacco roll along a substantial portion of the length thereof, the element frictionally engaging the tobacco roll and driving the tobacco roll out of the container through a pull on the element in a direction generally parallel to the longitudinal axis of the tobacco roll.

The one cigarette thus provided with a string may very simply be pulled out with no difficulty whatever and with the string easily discarded as it is preferably completely unattached to the cigarette.

Additionally, the provision of the string hardly adds to cost and does not require any modification in the making of the cigarettes or cigars themselves.

A description of a preferred form of the invention, with variants, now follows, as applied to the various types of packages, it being understood that the actual shape and structure of the package proper is of no importance, the invention being applicable to any type of packages as will readily be appreciated from the following description.

DESCRIPTION OF THE PREFERRED EMBODIMENT

In this specification, the term "tobacco roll" applies of course both to cigarettes and to cigars, although the description is restricted to cigarettes.

Figure 1:
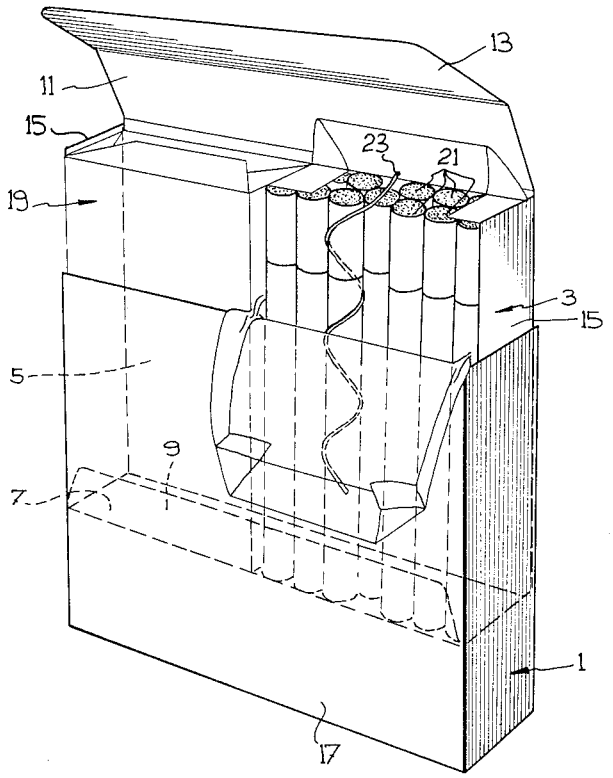
FIG. 1 is a perspective view of a smoker's package involving the use of the invention.

Referring to FIG. 1, the cigarette package comprises, in known manner, an outer cover 1 made of soft cardboard material and having the form of an open-ended conduit, rectangular in cross-section.

Within the cover 1 is slidably and remoably mounted a housing 3 having a backwall 5; a bottom wall 7 turning upward into a front lower flap 9; a top wall 11 turning downward into an upper flap 13 and a pair of side walls 15 directed forwardly from the back wall 5. When closed, the housing 3 lodges fully inside the outer cover 1 with the flaps 9 and 13 tucked inside the outer cover 1 against the inner face of its front wall 17.

Two aluminum paper wrappers 19 are slid side by side in the housing 3, both containing tightly packed smoking tobacco rolls, in this case cigarettes 21 having each a generally constant cross-section along the length thereof. The leftward wrapper 19 is shown in closed condition, the rightward one in open condition clearly illustrating the tightly packed cigarettes 21 which are filter tipped but which could of course be without filters (as in FIG. 2).

The invention consists in providing at least one of the cigarettes with a string 23 wound around it as shown. The upper end of the string is located at, and is freely hanging from, the top end of the cigarette so that it may easily be finger-gripped when the package and wrapper are in the partially open condition of FIG. 1.

The string 23 has to have a winding length which is sufficient, when the string is pulled, to give rise to a bracing force on the body of the cigarette around which it is turned, which is strong enough to overcome the packing pressure which acts upon it. In this manner, pulling on the free end of the string will easily dislodge the cigarette from the pack without damaging the cigarette.

The string is preferably completely free of the cigarette, being wound helically around it with turns that are adquately spaced from one another.

The lower end of the string may possibly be glued to the cigarette although it is preferred that it be free therefrom for practical reasons in manufacture and also for reasons that, if long enough, the string truly need in no way be attached to the cigarette.

Figure 2:
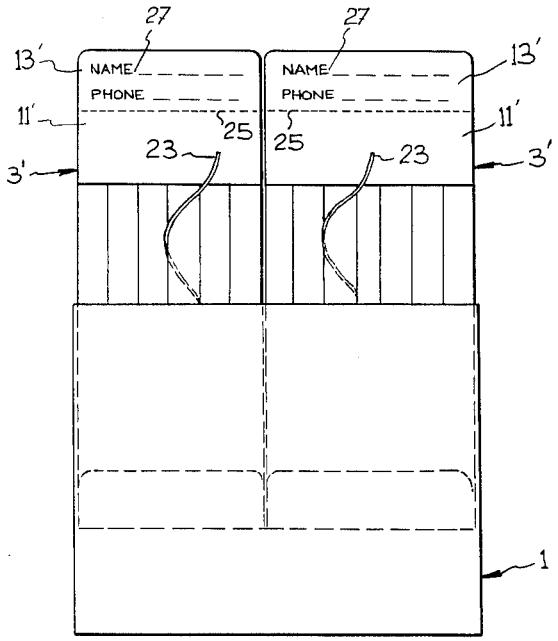
FIG. 2 is a front view of a smoker's package of a different form, likewise involving the use of the invention.

The string 23 is used, in the package of FIG. 2, in exactly the same manner as in the package of FIG. 1. In the FIG. 2 package, however, while two cigarette-packed wrappers are provided as in FIG. 1, each is advantageously contained in its own housing 3'; both housings 3' being fully independent of one another so that only one need be used at a time. Additionally, and for each housing 3', the top wall 11' and its companion upper flap 13' are separated from one another by a tear line 25' upper flap 13' further having indicia means 27 printed thereon. The indicia means may be in the form of the words <Name> and <Phone> followed by lines for writing the corresponding information.

It will be appreciated that the thus easily detachable flaps 13' may become identification tabs for use in writing the names, addresses, telephone numbers of persons. These tabs may be found convenient at opportune times such as during a business or social gathering to give to a partner.

String 23 may be in the form of a flat narrow strip of transparent or translucent plastic material or yet an elongated string likewise of plastic material, both obviously flexible.

As mentioned above, the invention is applicable to cigarettes that are tightly packed so that it may be used with cigarette packages other than those just described.

I claim:

1. In combination with a smoker's package of the type comprising a container enclosing a plurality of tobacco rolls, each tobacco roll being removable from said container through a pull on said tobacco roll in a direction generally parallel to the longitudinal axis thereof, a tobacco roll ejector device comprising an elongated flexible element spirally wound on a tobacco roll along a substantial portion of the length thereof, said elongated flexible element frictionally engaging the tobacco roll for driving the tobacco roll out of said container through a pull on said elongated flexible element in a direction generally parallel to the longitudinal axis of the tobacco roll.

2. A combination as defined in claim 1, wherein said flexible element is a string helically wound on the tobacco roll.

3. A combination as defined in claim 1, wherein said flexible element is a string made of plastic material.

4. A combination as defined in claim 1, wherein said tobacco rolls are cigarettes.

5. In combination with a cigarette package of the type comprising a container enclosing a plurality of cigarettes, each of said cigarettes having a generally constant cross-section along the length thereof and being removable from said container through a pull exerted on said cigarette along a longitudinal axis thereof, a cigarette ejector device comprising a flexible string spirally wound on one of said cigarettes along a substantial portion of the length thereof, said string frictionally engaging the cigarette and having an end adapted to be grasped with fingers for driving the cigarette out of said container through a pull exerted on said end of said string in a direction generally parallel to the longitudinal axis of said cigarette.

* * * * *